US011572261B2

(12) United States Patent
Bangalore Srinivas

(10) Patent No.: US 11,572,261 B2
(45) Date of Patent: Feb. 7, 2023

(54) AUTOMATED UNIT LOAD LIFTER MOUNTED ON AN AUTONOMOUS MOBILE ROBOT FOR CARRYING A UNIT LOAD

(71) Applicant: Tata Consultancy Services Limited, Mumbai (IN)

(72) Inventor: Venkatesh Prasad Bangalore Srinivas, Bangalore (IN)

(73) Assignee: TATA CONSULTANCY SERVICES LIMITED, Mumbai (IN)

( * ) Notice: Subject to any disclaimer, the term of this patent is extended or adjusted under 35 U.S.C. 154(b) by 53 days.

(21) Appl. No.: 17/206,384

(22) Filed: Mar. 19, 2021

(65) Prior Publication Data

US 2022/0055876 A1 Feb. 24, 2022

(30) Foreign Application Priority Data

Aug. 21, 2020 (IN) ..... 202021036041

(51) Int. Cl.
*B66F 9/06* (2006.01)
*B66F 9/10* (2006.01)

(52) U.S. Cl.
CPC ..... *B66F 9/063* (2013.01); *B66F 9/10* (2013.01)

(58) Field of Classification Search
CPC ..... B66F 9/10; B66F 9/07559; B66F 9/122
See application file for complete search history.

(56) References Cited

U.S. PATENT DOCUMENTS

| | | | | |
|---|---|---|---|---|
| 8,833,736 | B2 | 9/2014 | Feiquan et al. | |
| 11,111,121 | B2 * | 9/2021 | Nakamoto | B66F 9/07563 |
| 2005/0042068 | A1 * | 2/2005 | Ehmen | B66F 9/10 414/661 |
| 2019/0352158 | A1 * | 11/2019 | Tani | B66F 9/10 |
| 2020/0109038 | A1 * | 4/2020 | Nagasawa | G06T 7/70 |
| 2020/0307974 | A1 * | 10/2020 | Hasegawa | B66F 9/07554 |
| 2020/0393839 | A1 * | 12/2020 | Hasegawa | B62D 7/1509 |
| 2021/0130123 | A1 * | 5/2021 | Kurtz | B60P 1/022 |

FOREIGN PATENT DOCUMENTS

AU 2018282330 B2 1/2019

* cited by examiner

*Primary Examiner* — Mark C Hageman
(74) *Attorney, Agent, or Firm* — Finnegan, Henderson, Farabow, Garrett & Dunner LLP

(57) ABSTRACT

Typically, unit loads with wooden pallets in warehouses are moved by pallet lifters or AMRs which are bulkier in size and require more power with high operating costs. This disclosure relates generally to a unit load lifter designed with counterbalance arm mounted on an autonomous mobile robot (AMR) to load and unload unit load from one position to another position autonomously. The unit load lifter includes a horizontal slide unit and a vertical axis fork assembly. The horizontal slide unit include base plate of the unit load lifter is mounted on the AMR. A plurality of fixed guides is integrated with the base plate to house the vertical axis fork assembly by a plurality of rollers on a roller mounting plate. The vertical axis fork assembly include an actuating end of a linear actuator is connected to the sliding plate to drive the at least one fork up and down.

20 Claims, 15 Drawing Sheets

STEP 1

STEP 2

STEP 3

STEP 4

STEP 5

STEP 6

STEP 7

STEP 8

AUTOMATED UNIT LOAD LIFTER MOUNTED ON AN AUTONOMOUS MOBILE ROBOT FOR CARRYING A UNIT LOAD

PRIORITY CLAIM

This U.S. patent application claims priority under 35 U.S.C. § 119 to: India Application No. 202021036041, filed on Aug. 21, 2020. The entire contents of the aforementioned application are incorporated herein by reference.

TECHNICAL FIELD

This disclosure relates generally to a robotics system, and, more particularly, to a unit load lifting unit, which includes an automated unit load lifter mounted on an autonomous mobile robot for carrying a unit load.

BACKGROUND

Currently the industry environment is transforming with traditional warehouses into smart warehouses. There are numerous fork type pallet movers or forklift trucks available in the warehouses. Typically, in warehouses the unit loads with wooden pallets are moved by fork type pallet lifters and are operated by humans. Also, there are fork type automated guided vehicles (AGV) or fork type autonomous mobile robots (AMR) to perform a job. These vehicles are having a large counterweight or counterbalance mechanism underneath the fork. Further the conventional vehicles in the warehouse are longer in size and hence wheelbase requires longer maneuvering space and are unable to park in tight spaces. Unlike the conventional vehicles, a pallet type autonomous mobile robots have zero turning radius enabling a vehicle to rotate about its own center. Secondly, the "Fork type" AGVs, pallet lifters or AMRs are bulkier in size and significantly heavier and require more power and operating costs are high as compared to unit load AMRs.

SUMMARY

Embodiments of the present disclosure present technological improvements as solutions to one or more of the above-mentioned technical problems recognized by the inventors in conventional systems. For example, in one embodiment, a unit load lifter mounted on an autonomous mobile robot (AMR) to carry a unit load is provided. The unit load lifter includes a horizontal slide unit and a vertical axis fork assembly. The horizontal slide unit includes a base plate of the unit load lifter is mounted on the AMR; a plurality of unit load resting surfaces is mounted on to the base plate with a plurality of stand-offs; a plurality of fixed guides are integrated with the base plate to house the vertical axis fork assembly by a plurality of rollers; a pinion gear and a motor mounted on the vertical axis fork assembly coupled with a rack gear for creating a desired horizontal motion; and a plurality of counterbalance curvy slides are integrated with the base plate. The vertical axis fork assembly includes a support plate weldment with the plurality of rollers integrated on either side to roll on at least one channel in the plurality of fixed guides of the horizontal slide unit to create a horizontal motion of the vertical axis fork assembly; a plurality of linear motion (LM) guide blocks is sandwiched between a sliding plate and a plurality of linear motion (LM) rails; an at least one fork from a plurality of forks is vertically mounted on the sliding plate; and an actuating end of a linear actuator is connected to the sliding plate to drive the at least one fork up and down. In an embodiment, the base plate is configured to hold a plurality of components of the unit load lifter. In an embodiment, the unit load is mounted on at least two-unit load resting surfaces from the plurality of unit load resting surfaces. In an embodiment, the plurality of rollers is mounted on a roller mounting plate. In an embodiment, the sliding plate is configured to slide vertically and linearly up and down. In an embodiment, the plurality of LM rails is mounted on a vertical mounting plate.

In an embodiment, the plurality of unit load resting surface may include at least one of (i) a central gap includes a space for the rack gear, and (ii) two gaps on either side of the plurality of unit load resting surface which includes a space for the plurality of forks. In an embodiment, a top surface of the plurality of forks may be positioned below a top surface of the plurality of unit load resting surfaces. In an embodiment, the plurality of unit load resting surface may include a plurality of unit load entry enabler at a plurality of ends to house the unit load at a desired location. In an embodiment, the plurality of unit load resting surface may include a plurality of unit load position enabler to direct the unit load towards the plurality of unit load resting surface. In an embodiment, a plurality of counterbalance arms may correspond to a left hand (LH) counterbalance arm and a right hand (RH) counterbalance arm. In an embodiment, the plurality of counterbalance curvy slides may correspond to a left hand (LH) counterbalance curvy slide and a right hand (RH) counterbalance curvy slide. In an embodiment, the LH counterbalance curvy slide may consist of the LH counterbalance arm which rolls in a curvy channel with at least two rollers. In an embodiment, the at least two rollers may correspond to a guided roller and an anti-rotation roller respectively. In an embodiment, the RH counterbalance curvy slide may consist of the RH counterbalance arm. In an embodiment, a plurality of coil springs may be attached to the guided roller to provide a pulling force for retaining the guided roller along with the plurality of counterbalance arms towards a second end (Y) of the plurality of counterbalance curvy slides thereby preventing free movement of the counterbalance arms. In an embodiment, the guided roller may not engage with a plurality of slotted links.

In an embodiment, the guided roller and the anti-rotation roller may move along the plurality of counterbalance curvy slides. In an embodiment, a track roller of the guided roller may pass through a track clearance opening of the plurality of counterbalance curvy slide and a track clearance opening of the base plate to provide a rolling contact with a track of the plurality of slotted links. In an embodiment, the plurality of slotted links may include a horizontal segment of a slotted channel with a closed end A, and a connecting end B which are connected to a vertical segment of the slotted channel. In an embodiment, the vertical segment of the slotted channel may open at an open end C. In an embodiment, the track roller of the guided roller may engage with the open end C when the vertical axis fork assembly moves towards the unit load placed on the floor surface. In an embodiment, the connecting end B and the open end C may engage when the vertical axis fork assembly moves towards the unit load placed on the floor surface. In an embodiment, the track roller may move from the open end C to the connecting end B of the plurality of slotted links when the vertical axis fork assembly moves towards the unit load placed on the floor surface.

In an embodiment, a bearing roller of the guided roller may move from the second end (Y) of the plurality of counterbalance curvy slides to a first end (Z) of the plurality of counterbalance curvy slides. In an embodiment, a locating step of the guided roller may cause movement of the at least one counterbalance arm towards a floor surface. In an embodiment, the track roller may move from the connecting end B to the closed end A of the track of the plurality of the slotted links when the vertical axis fork assembly moves further towards the unit load. In an embodiment, the bearing roller of the guided roller may be without motion to retain the at least one counterbalance arm towards the floor surface. In an embodiment, the horizontal segment between the closed end A and the connecting end B may be integrated with the guided roller and the anti-rotation roller with no relative motion to maintain the at least one counterbalance arm at a desired position. In an embodiment, the anti-rotation roller may be coupled with the guided roller.

In an embodiment, the bearing roller of the guided roller along with a bearing roller of the anti-rotation roller may be moved constrained between a upper slot of the plurality of counterbalance curvy slides and a lower slot of the plurality of counterbalance curvy slides, thereby causing a specific curvy path along the plurality of counterbalance arms. In an embodiment, the vertical axis fork assembly may move away from a loading position towards a central portion of the AMR when the track roller of the guided roller is completely disengaged from the open end C. In an embodiment, the at least one counterbalance arm may be at top position to initiate transportation of the unit load.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this disclosure, illustrate exemplary embodiments and, together with the description, serve to explain the disclosed principles.

DETAILED DESCRIPTION

Figure 1A:
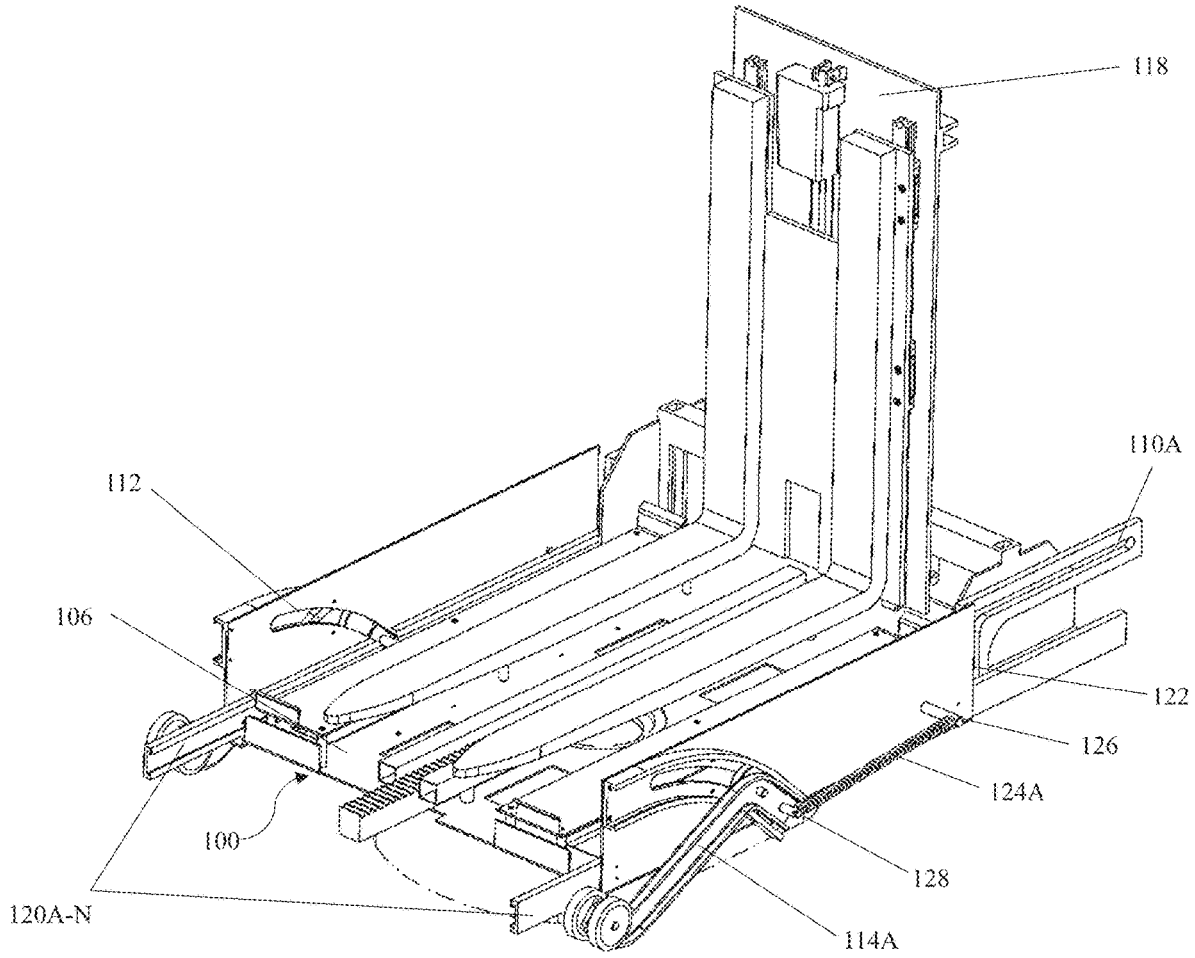
FIGS. 1A-1D are isometric views depicting a plurality of parts/components of a unit load lifter mounted onto an autonomous mobile robot (AMR) and a unit load, according to some embodiments of the present disclosure.

Exemplary embodiments are described with reference to the accompanying drawings. In the figures, the left-most digit(s) of a reference number identifies the figure in which the reference number first appears. Wherever convenient, the same reference numbers are used throughout the drawings to refer to the same or like parts. While examples and features of disclosed principles are described herein, modifications, adaptations, and other implementations are possible without departing from the scope of the disclosed embodiments. It is intended that the following detailed description be considered as exemplary only, with the true scope being indicated by the following claims.

Embodiments of the present disclosure provide a unit load lifter mounted on an autonomous mobile robot (AMR) or an autonomous guided vehicle (AGV) for lifting of a unit load in warehouses and logistics areas. The unit load lifter with help of the autonomous mobile robot (AMR) or the autonomous guided vehicle (AGV) can pick the unit load up from a certain position and transfer from one position to another position autonomously. The AMR with the unit load lifter can go underneath a pallet and lift from ground up to a certain height and transfer the unit load. Once the destination point is reached by the AMR, the unit load lifter works in reverse order to place the unit load onto the ground. The unit load lifter is specially designed with a counterbalance arm to provide stability to entire unit while loading and unloading of the unit load. A position of the pallet and destination identifications are performed by the AMR.

Referring now to the drawings, and more particularly to FIGS. 1 through 7D, where similar reference characters denote corresponding features consistently throughout the figures, there are shown preferred embodiments and these embodiments are described in the context of the following exemplary system and/or method.

Reference numerals of one or more components of a unit load lifter with an autonomous mobile robot (AMR) and a unit load as depicted in the FIGS. 1 through 7B are provided in Table 1 below for ease of description.

TABLE 1

| S. NO | NAME OF COMPONENT | REFERENCE NUMERALS |
|---|---|---|
| 1 | Unit load lifter | 100 |
| 2 | Autonomous Mobile Robot (AMR)/Automated guided vehicle (AGV) | 102 |
| 3 | Unit load | 104 |
| 4 | Base plate | 106 |
| 5 | Plurality of slotted link | 110A-B |
| 6 | Guide roller slot | 112 |
| 7 | Plurality of counterbalance arms | 114A-B |
| 8 | Rack gear | 116 |
| 9 | Vertical axis Fork assembly | 118 |
| 10 | Plurality of fixed guides | 120A-N |
| 11 | Horizontal slide unit | 122 |
| 12 | Plurality of coil springs | 124A-B |
| 13 | Fixed end for mounting the coil spring | 126 |
| 14 | Spring mounting hole | 128 |
| 15 | Unit load lifting plate | 130 |
| 16 | Unit load pusher plate | 132 |
| 17 | Sliding plate | 202 |
| 18 | Linear actuator | 204 |
| 19 | Plurality of linear motion (LM) guides | 206A-N |
| 20 | Plurality of forks | 208A-B |
| 21 | Vertical mounting plate | 210 |
| 22 | Horizontal support weldment | 212 |
| 23 | LH support plate | 214 |
| 24 | RH Support plate | 216 |
| 25 | Plurality of rollers | 218A-N |
| 26 | Motor | 220 |
| 27 | Pinion gear | 222 |
| 28 | Support plate weldment | 224 |
| 29 | Roller mounting plate | 226 |
| 30 | Plurality of linear motion (LM) rails | 228A-N |

TABLE 1-continued

| S. NO | NAME OF COMPONENT | REFERENCE NUMERALS |
|---|---|---|
| 31 | Plurality of counterbalance curvy slide | 302A-B |
| 32 | Track clearance opening | 304A-B |
| 33 | Guided roller | 306 |
| 34 | Anti-rotation roller | 308 |
| 35 | Upper slot of the counterbalance curvy slides | 312 |
| 36 | Lower slot of the counterbalance curvy slides | 314 |
| 37 | Locating holes | 316A-B |
| 38 | Track roller of the guided roller | 310 |
| 39 | Bearing roller of the guided roller | 320 |
| 40 | Step of the guided roller | 322 |
| 41 | Locating step of the guided roller | 324 |
| 42 | Bearing roller of the anti-rotation roller | 326 |
| 43 | Step of the anti-rotation roller | 328 |
| 44 | Locating step of the anti-rotation roller | 330 |
| 45 | Plurality of unit load resting surface | 402A-D |
| 46 | Plurality of stand-offs | 404A-B |
| 47 | Track of the slotted link | 406 |
| 48 | Plurality of unit load entry enabler | 502A-D |
| 49 | Plurality of unit load position enabler | 504A-D |

Figure 1B:
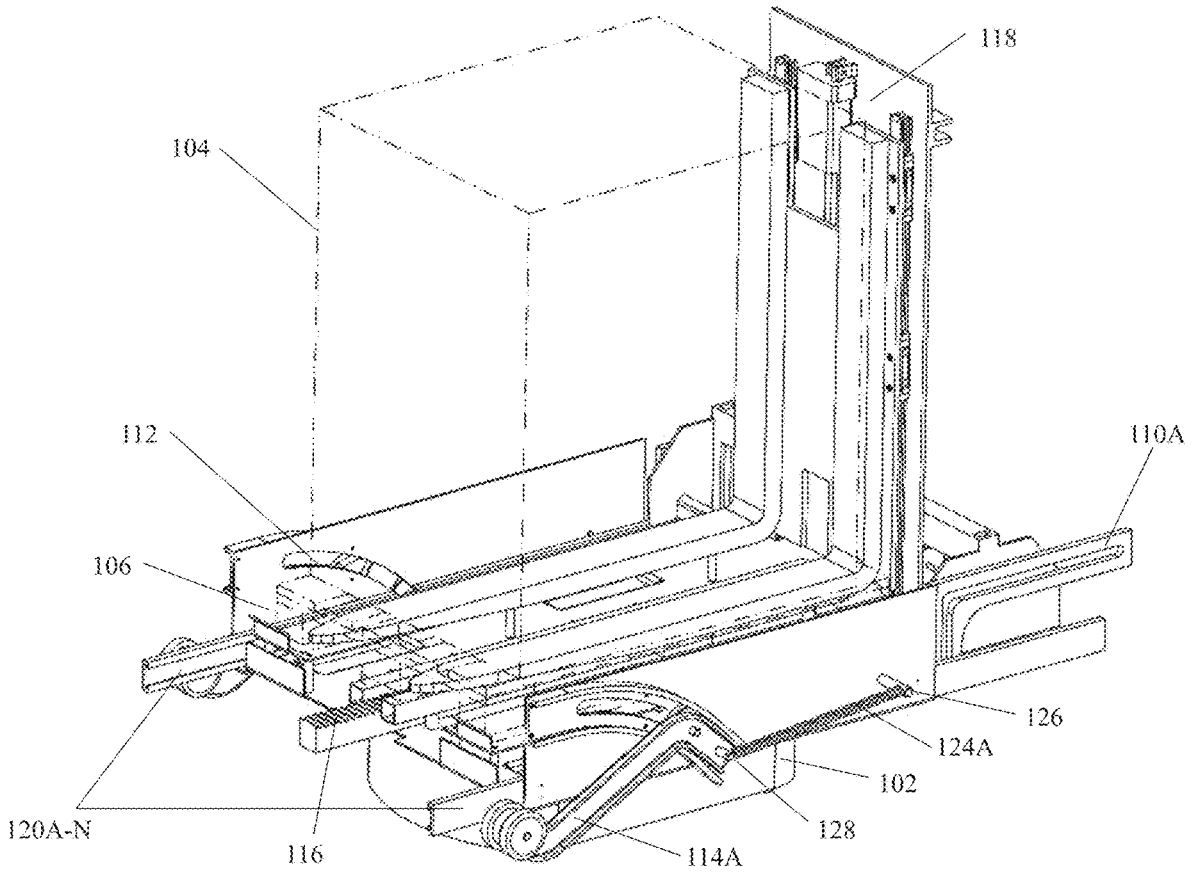
Figure 2A:
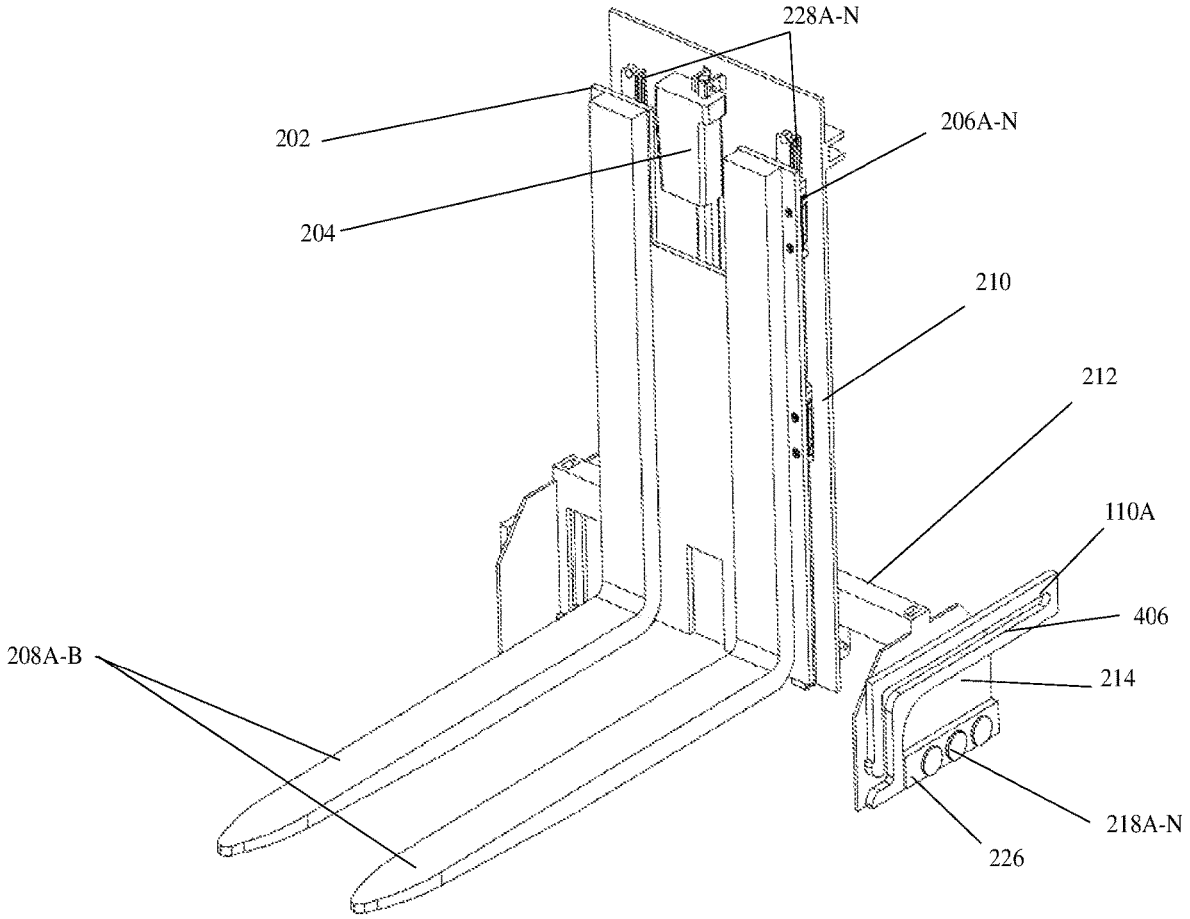
FIG. 2A is an isometric front view of a vertical axis fork assembly of the unit load lifter, according to some embodiments of the present disclosure.

FIGS. 1A-1B are isometric views depicting a plurality of components of the unit load lifter 100 mounted on to autonomous mobile robot (AMR) 102 and the unit load 104, according to some embodiments of the present disclosure. The unit load lifter 100 is specially designed in a way to mount onto an autonomous mobile vehicle (AMR)/an automated guided vehicle (AGV) 102. The unit load lifter 100 includes at least one platform for providing multiple mechanisms for performing load movement such as (i) a vertical platform to perform vertical movement (e.g., lifting the unit load), (ii) a horizontal platform to perform horizontal mechanism (e.g., sliding the unit load), and (iii) providing anti-toppling support. In an embodiment, the unit load lifter 100 consists of the plurality of forks 208A-B (as depicted in FIG. 2A) which moves below the unit load 104 (e.g., a pallet) and lifts the unit load 104 onto the horizontal platform of the unit load lifter 100. In an embodiment, the vertical platform is configured to move along height of the AMR 102 and provides support to lift a loaded pallet from the ground and position onto the AMR 102. In an embodiment, the horizontal platform is configured to slide lengthwise of the of the AMR 102 and slides entire fork assembly until the loaded pallet gets positioned. In an embodiment, the anti-toppling support mechanism supports the AMR 102 to prevent from toppling during loading of the unit load 104 from a floor surface.

Figure 5:
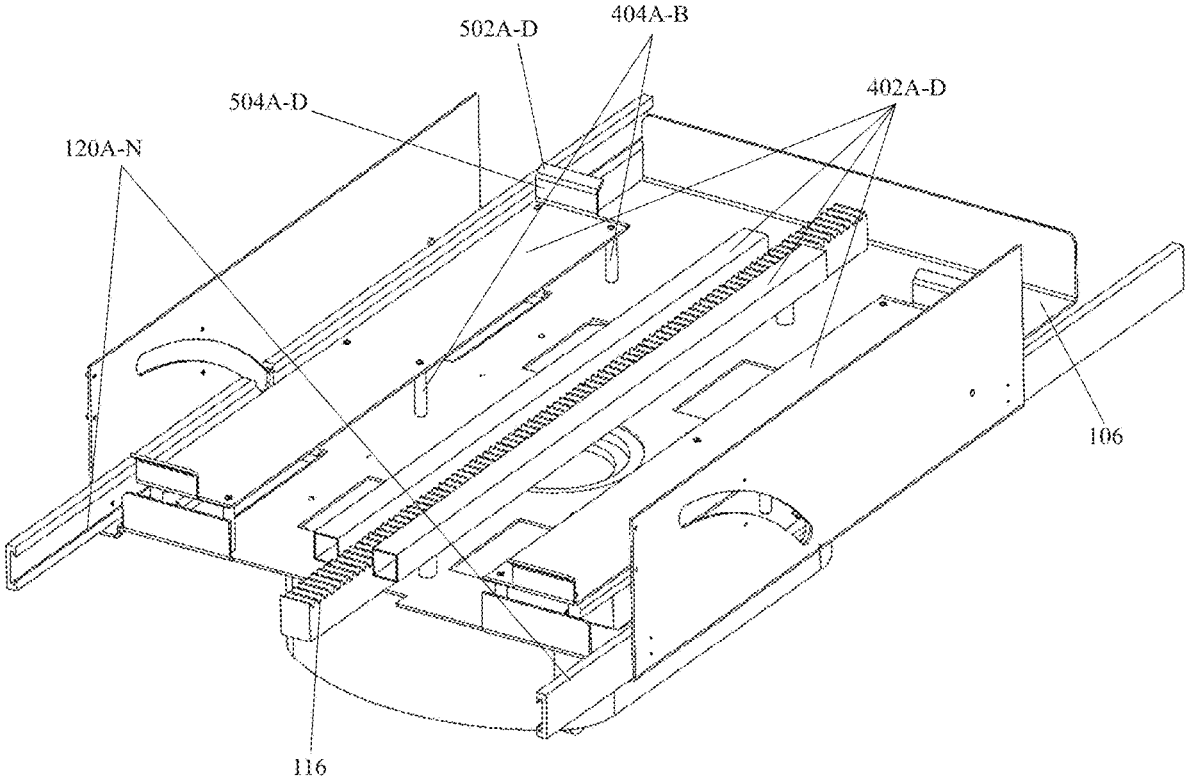
FIG. 5 is an isometric view of the bottom plate of the unit load lifter, according to some embodiments of the present disclosure.

In an alternate embodiment, the horizontal platform and the vertical platform corresponds to a horizontal slide unit 122 and a vertical axis fork assembly 118 respectively. The horizontal slide unit 122 includes the base plate 106 of the unit load lifter 100, which is mounted on the AMR 102. The base plate 106 is designed to hold a plurality of components of the unit load lifter 100. The horizontal slide unit 122 includes a plurality of unit load resting surfaces 402A-D (as depicted in FIG. 5), which are mounted on to the base plate 106 with a plurality of stand-offs 404A-B. The unit load 104 is mounted on at least two-unit load resting surfaces from the plurality of unit load resting surfaces 402A-D. The horizontal slide unit 122 includes the plurality of fixed guides 120A-N, which are integrated with the base plate 106 to house the vertical axis fork assembly 118 by a plurality of rollers 218A-N. In an embodiment, the plurality of rollers 218A-N are mounted on a roller mounting plate 226. The horizontal slide unit 122 include a pinion gear 222 (as depicted in FIG. 2B) and a motor 220 (as depicted in FIG. 2B) mounted on the vertical axis fork assembly 118 coupled with a rack gear 116 (as depicted in FIG. 1) for creating a desired horizontal motion. The horizontal slide unit 122 includes a plurality of counterbalance curvy slides 302A-B, which are integrated with the base plate 106. In an embodiment, the plurality of counterbalance curvy slides 302A-B corresponds to a left hand (LH) counterbalance curvy slide 302A and a right hand (RH) counterbalance curvy slide 302B. In an embodiment, for smooth movement, two fixed guides 120A-B are integrated with the base plate 106 along inside surface where the plurality of rollers 220A-N from the vertical axis engage with the fixed guides 120A-B to provide free rolling motion to the vertical assembly from one extreme to the other.

Figure 1C:
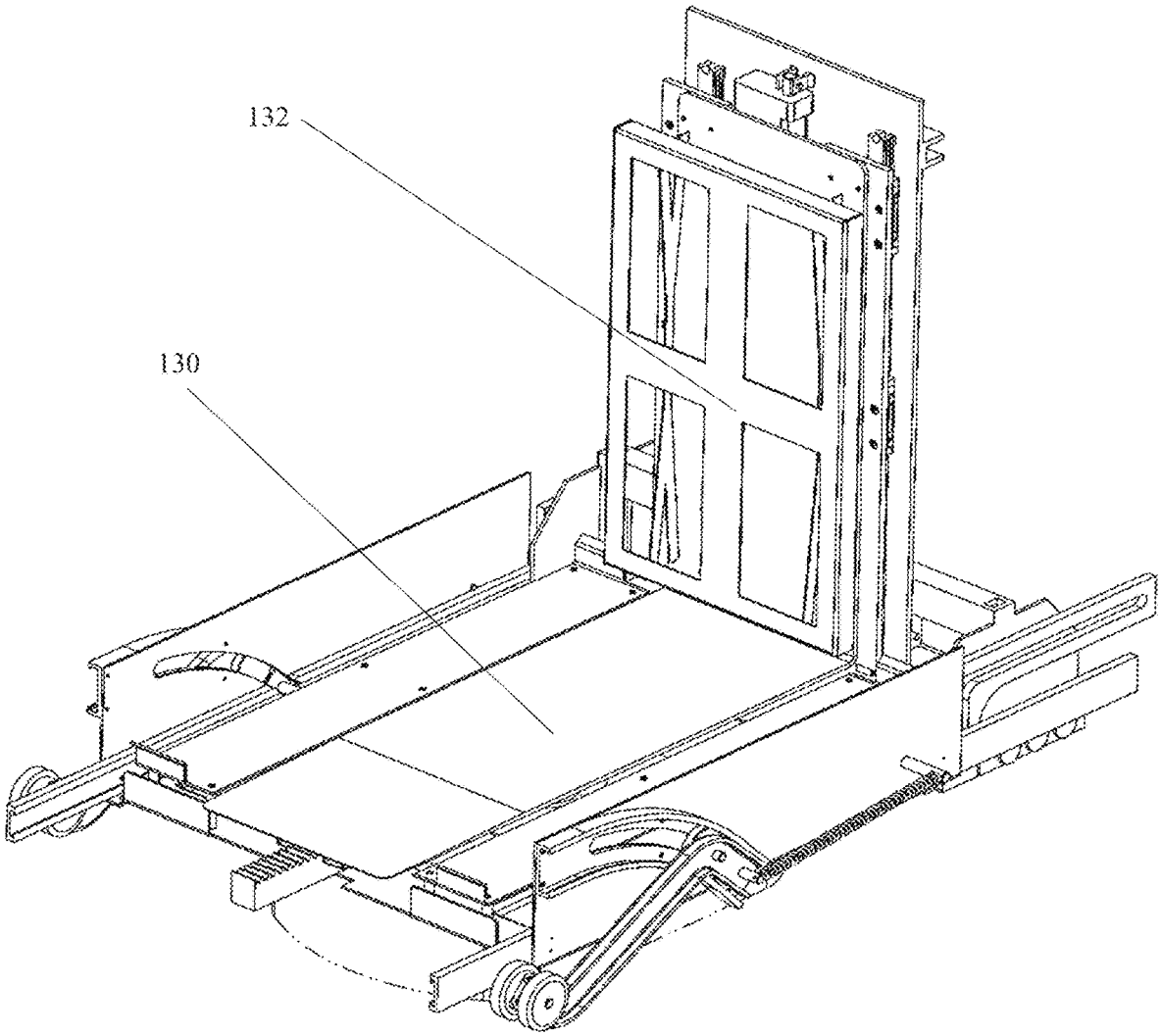
Figure 1D:
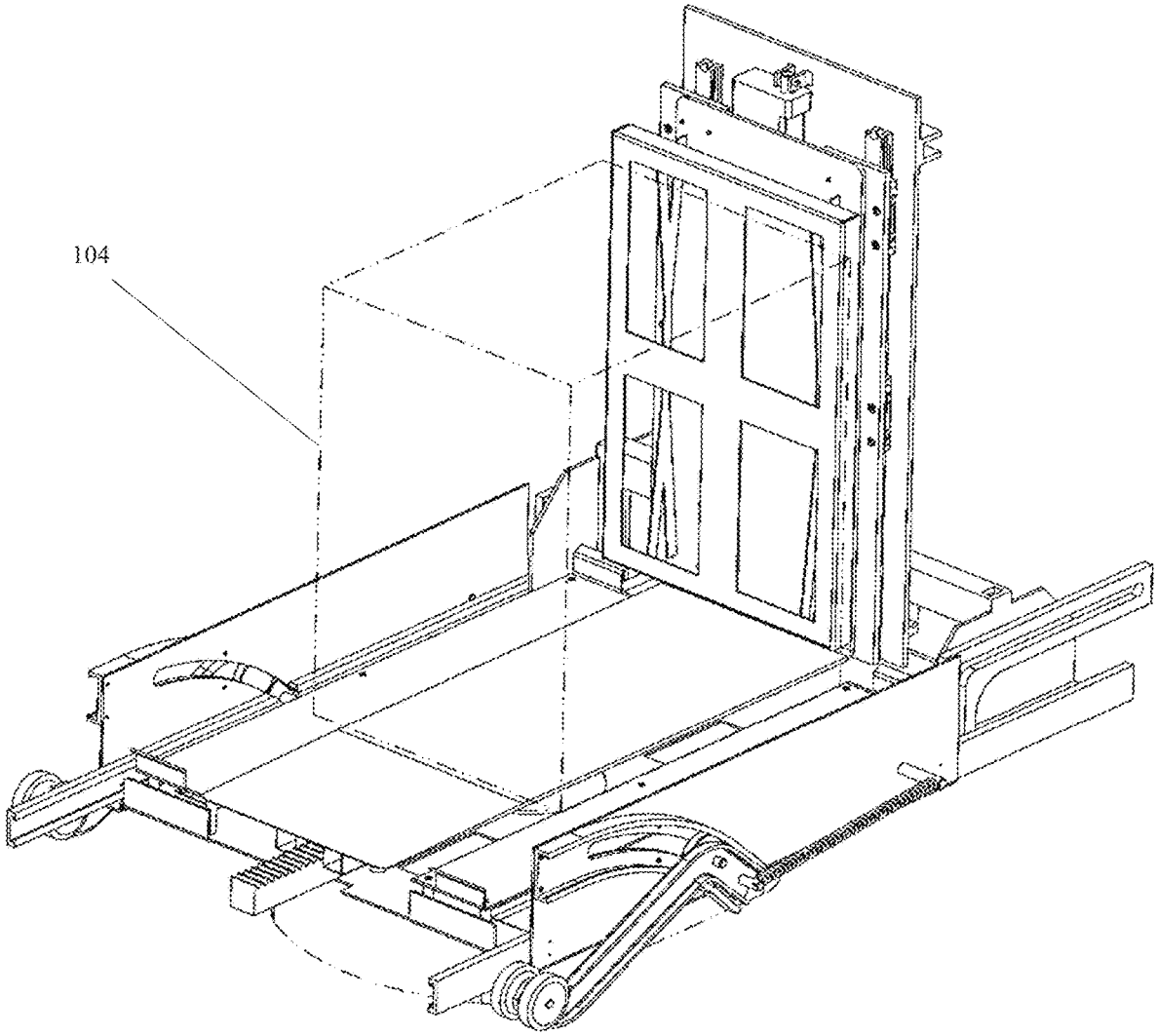
Figure 2B:
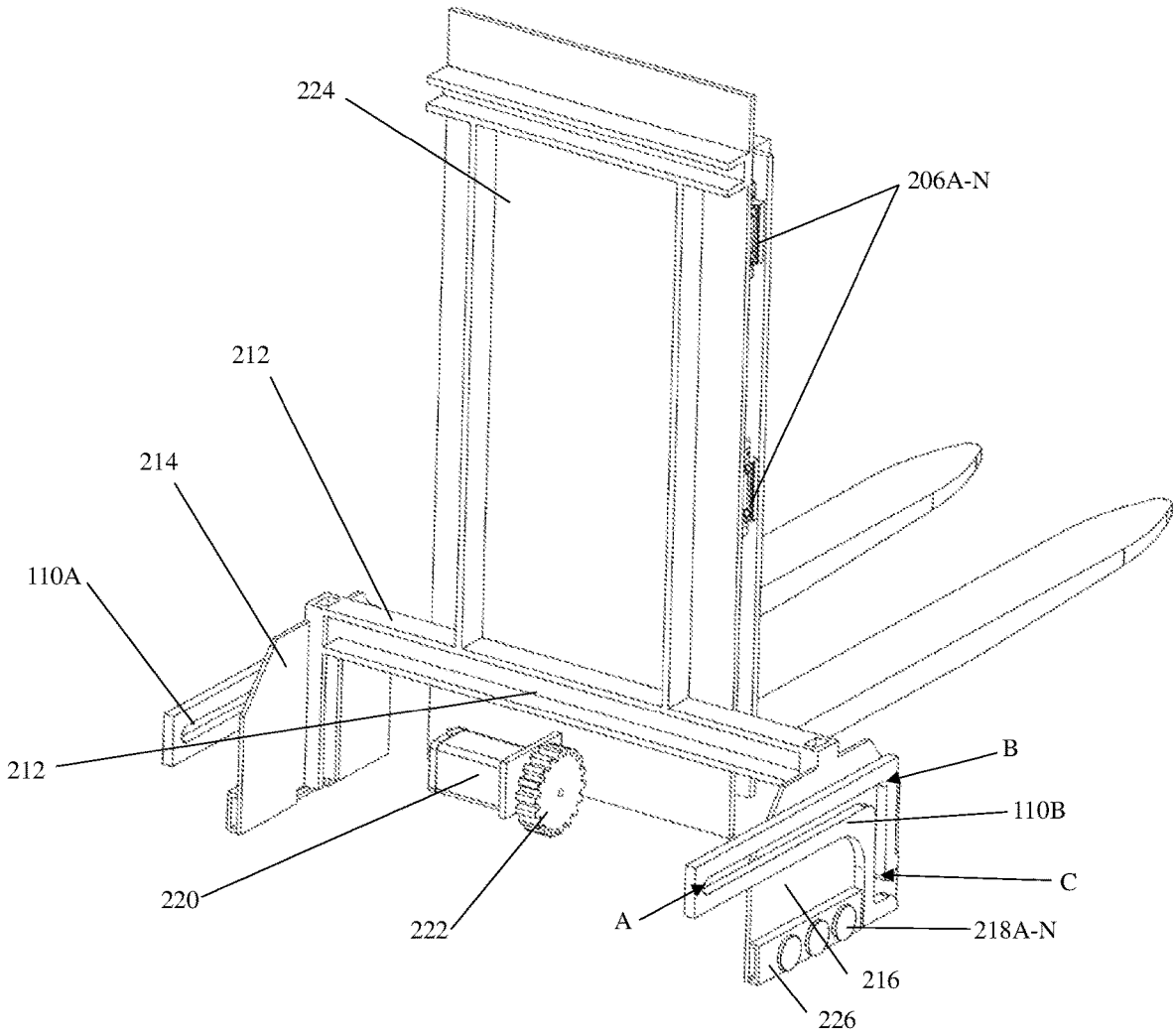
FIG. 2B is an isometric rear view of the vertical axis fork assembly of the unit load lifter, according to some embodiments of the present disclosure.

FIGS. 1C-1D are exemplary isometric views of the unit load lifter 100 with the autonomous mobile robot (AMR) 102 and the unit load 104, according to some embodiments of the present disclosure. In another exemplary embodiment, the unit load lifter 100 is designed without one or more forks for loading and unloading the unit load 104. The unit load lifter 100 includes a unit load lifting plate 130, and a unit load pusher plate 132. The unit load lifting plate 130 is mounted on the base plate 106 and the unit load lifting plate 130 designed to lift the unit load 104. The unit load pusher plate 132 is mounted on the vertical mounting plate 210 (as depicted in FIG. 2A) to push the unit load 104 while unloading the unit load lifter 100 from the unit load lifter 100. In another exemplary embodiment, the unit load lifter 100 is designed to mount more than one or more lifting attachments for various type of the lifting load.

FIG. 2A and FIG. 2B are an isometric front view and an isometric rear view of the vertical axis fork assembly 118 of the unit load lifter 100 respectively, according to some embodiments of the present disclosure. The vertical axis fork assembly 118 includes a support plate weldment 224 with the plurality of rollers 218A-N integrated on either side to roll on at least one channel in the plurality of fixed guides 120A-N of the horizontal slide unit 122 to create a horizontal motion of the vertical axis fork assembly 118. The vertical axis fork assembly 118 on which a plurality of linear motion (LM) guide blocks 206A-N is sandwiched between a sliding plate 202 and a plurality of linear motion (LM) rails 228A-N. The sliding plate 202 is configured to slide vertically and linearly up and down. The plurality of LM rails 228A-N are mounted on a vertical mounting plate 210.

The vertical axis fork assembly 118 includes at least one fork from a plurality of forks 208A-B, which is vertically mounted on the sliding plate 202. The vertical axis fork assembly 118 includes an actuating end of a linear actuator 204 is connected to the sliding plate 202 to drive the at least one fork up and down. In an embodiment, the linear actuator 204 is fitted to the horizontal support weldment 212 with help of screws. In an embodiment, the linear actuator 204 provides the linear (i.e., up and down) motion, while the plurality of LM guides 206A-N provide a route and smooth motion of the system. In an embodiment, the two forks 208A-B are mounted onto the sliding plate 202 with help of the screws where free to slide in the plurality of LM guides 206A-N. In an embodiment, an actuating end of the linear actuator 204 is connected to the vertical mounting plate 210 in order to drive the plurality of fork 208A-B up and down as required.

The vertical axis fork assembly 118 also consists of the plurality of slotted links 110A-B integrated on both side to pull or push at least two rollers to enable motion of a plurality of counterbalance arms 114A-B. The plurality of counterbalance arms 114A-B corresponds to a left hand (LH) counterbalance arm 114A and a right hand (RH)

counterbalance arm 114A. The LH counterbalance curvy slide 302A consists of the LH counterbalance arm 114A which rolls in a curvy channel with at least two rollers. In an embodiment, the at least two rollers correspond to a guided roller 306 and an anti-rotation roller 308 respectively. In an embodiment, the RH counterbalance curvy slide 302B consists of the RH counterbalance arm 114B. In an embodiment, the plurality of slotted links 110A-B are designed to facilitate proper positioning of the plurality of counterbalance arm 114A-B.

Figure 3:
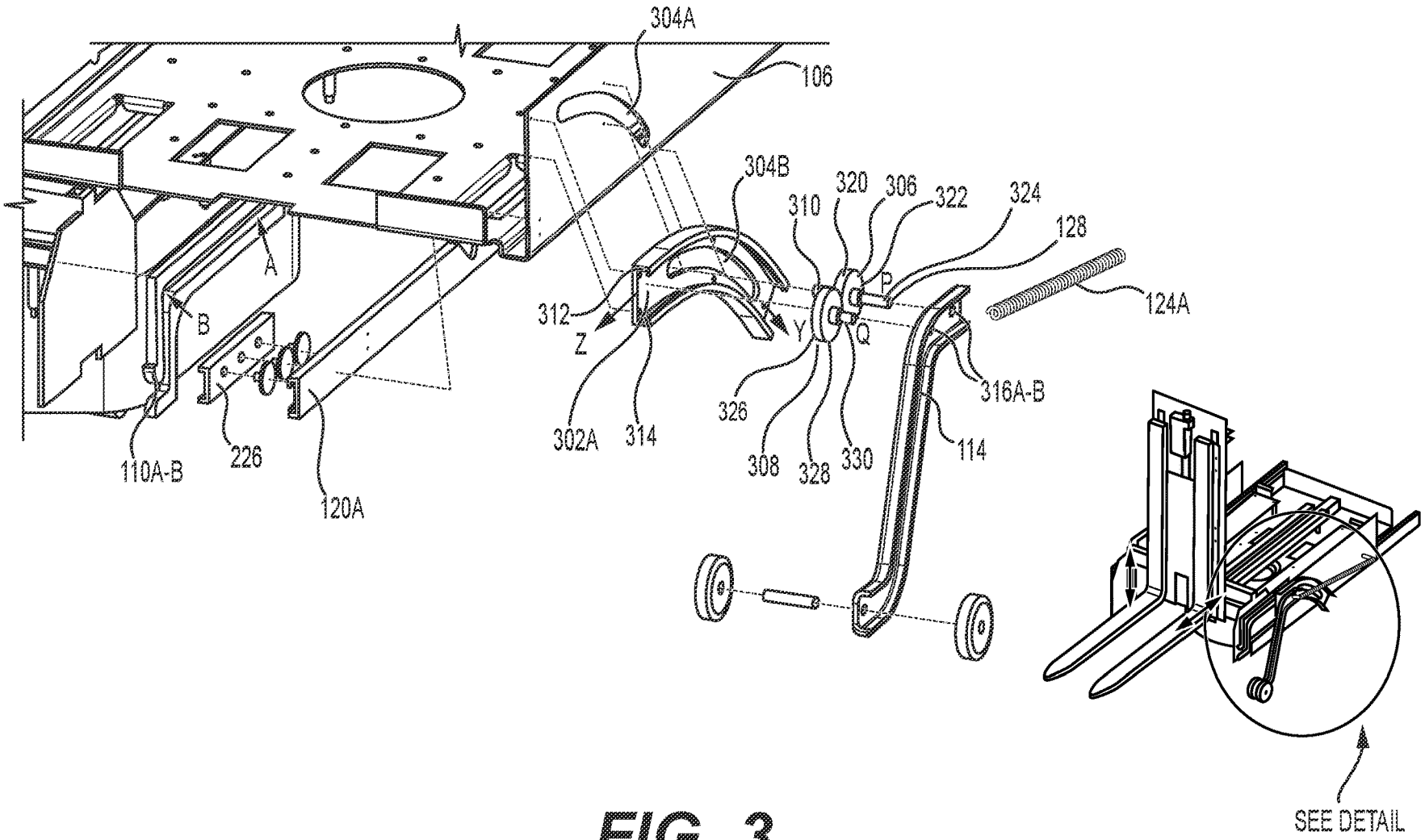
FIG. 3 is an exploded view of a counterbalance arm of the unit load lifter, according to some embodiments of the present disclosure.

FIG. 3 is an exploded view of the counterbalance arm 118 of the unit load lifter 100, according to some embodiments of the present disclosure. A plurality of coil springs 124A-B is attached to the guided roller 306 to provide a pulling force for retaining the guided roller 306 along with the plurality of counterbalance arms 114A-B towards a second end (Y) of the plurality of counterbalance curvy slides 302A-B thereby preventing free movement of the counterbalance arms 114A-B. In an embodiment, the guided roller 306 is not engaged with a plurality of slotted links 110A-B. The guided roller 306 and the anti-rotation roller 308 move along the plurality of counterbalance curvy slides 302A-B. A track roller 310 of the guided roller 306 passes through a track clearance opening 304B of the plurality of counterbalance curvy slide 302A-B and a track clearance opening 304A of the base plate (106) to provide a rolling contact with a track 406 of the plurality of slotted links 110A-B.

The plurality of slotted links 110A-B include a horizontal segment of a slotted channel with a closed end A, and a connecting end B which are connected to a vertical segment of the slotted channel. In an embodiment, the vertical segment of the slotted channel is open at an open end C. The track roller 310 of the guided roller 306 engages with the open end C when the vertical axis fork assembly 118 moves towards the unit load 104 placed on the floor surface. The connecting end B and the open end C engage when the vertical axis fork assembly 118 moves towards the unit load 104 placed on the floor surface. The track roller 310 moves from the open end C to the connecting end B of the plurality of slotted links 110A-B when the vertical axis fork assembly 118 moves towards the unit load 104 placed on the floor surface. A bearing roller 320 of the guided roller 306 moves from the second end (Y) of the plurality of counterbalance curvy slides 302A-B to a first end (Z) of the plurality of counterbalance curvy slides 302A-B. A locating step 324 of the guided roller 306 causes movement of the at least one counterbalance arm 114A towards a floor surface.

The track roller 310 moves from the connecting end B to the closed end A of the track 406 of the plurality of the slotted links 110A-B when the vertical axis fork assembly 118 moves further towards the unit load 104. The bearing roller 320 of the guided roller 306 without motion to retain the at least one counterbalance arm 114A towards the floor surface. The horizontal segment between the closed end A and the connecting end B integrated with the guided roller 306 and the anti-rotation roller 308 with no relative motion to maintain the at least one counterbalance arm 114A at a desired position. The anti-rotation roller 308 is coupled with the guided roller 306. The bearing roller 320 of the guided roller 306 along with a bearing roller 328 of the anti-rotation roller 308 are moved constrained between a upper slot 312 of the plurality of counterbalance curvy slides 304A-B and a lower slot 314 of the plurality of counterbalance curvy slides 304A-B, thereby causing a specific curvy path along the plurality of counterbalance arms 114A-B. The vertical axis fork assembly 118 moves away from a loading position towards a central portion of the AMR 102 when the track roller 320 of the guided roller 306 is completely disengaged from the open end C. The at least one counterbalance arm 114A is at top position to initiate transportation of the unit load 104.

The plurality of counterbalance arms 118A-B in which A, B, C are the three different points on the plurality of slotted link 110A-B i.e., $1^{st}$ end (Z) and $2^{nd}$ end (Y) of curvy slide signifies front and back end of the curvy slide.

Where Q—position of the anti-rotation roller 308 when closer to the $1^{st}$ end of the curvy slide.

P— position of the guided roller 306 when closer to the $1^{st}$ end of the curvy slide.

Q'—position of the anti-rotation roller 308 when closer to the $2^{nd}$ end of the curvy slide.

P'— position of the guided roller 306 when closer to the $2^{nd}$ end of the curvy slide.

Figure 4A:
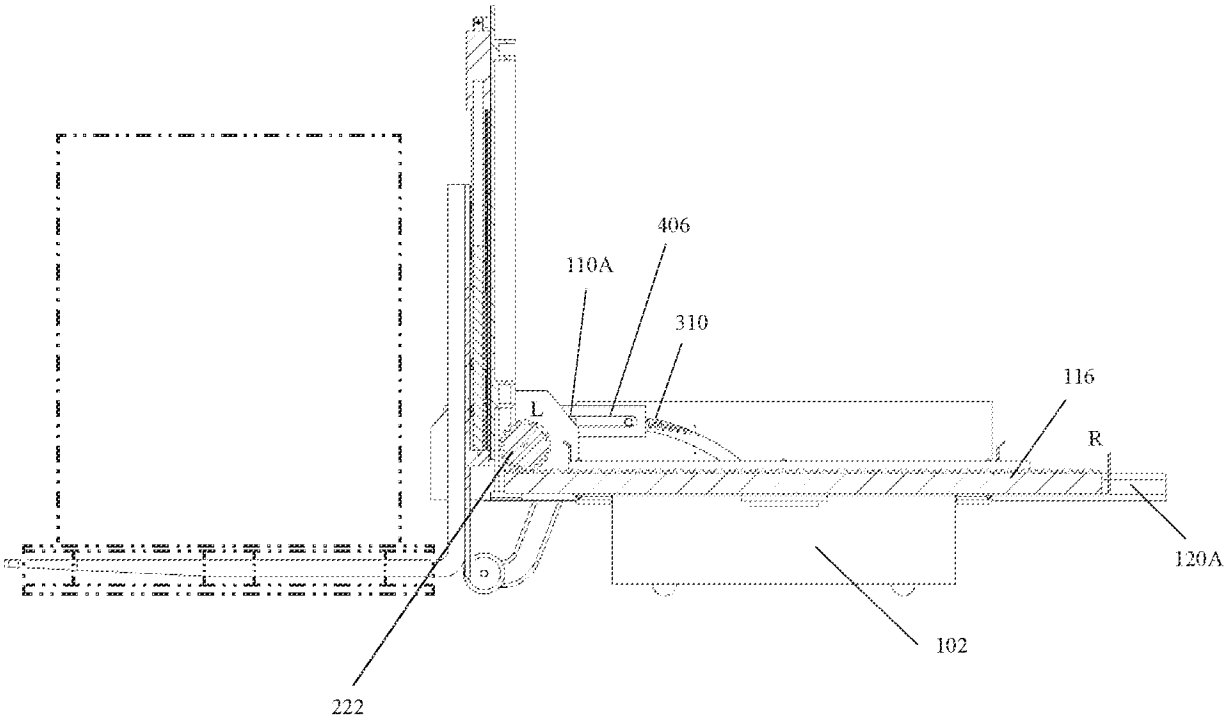
FIGS. 4A and 4B are side sectional views of the unit load lifter with the autonomous mobile robot and the unit load, according to some embodiments of the present disclosure.
Figure 4B:
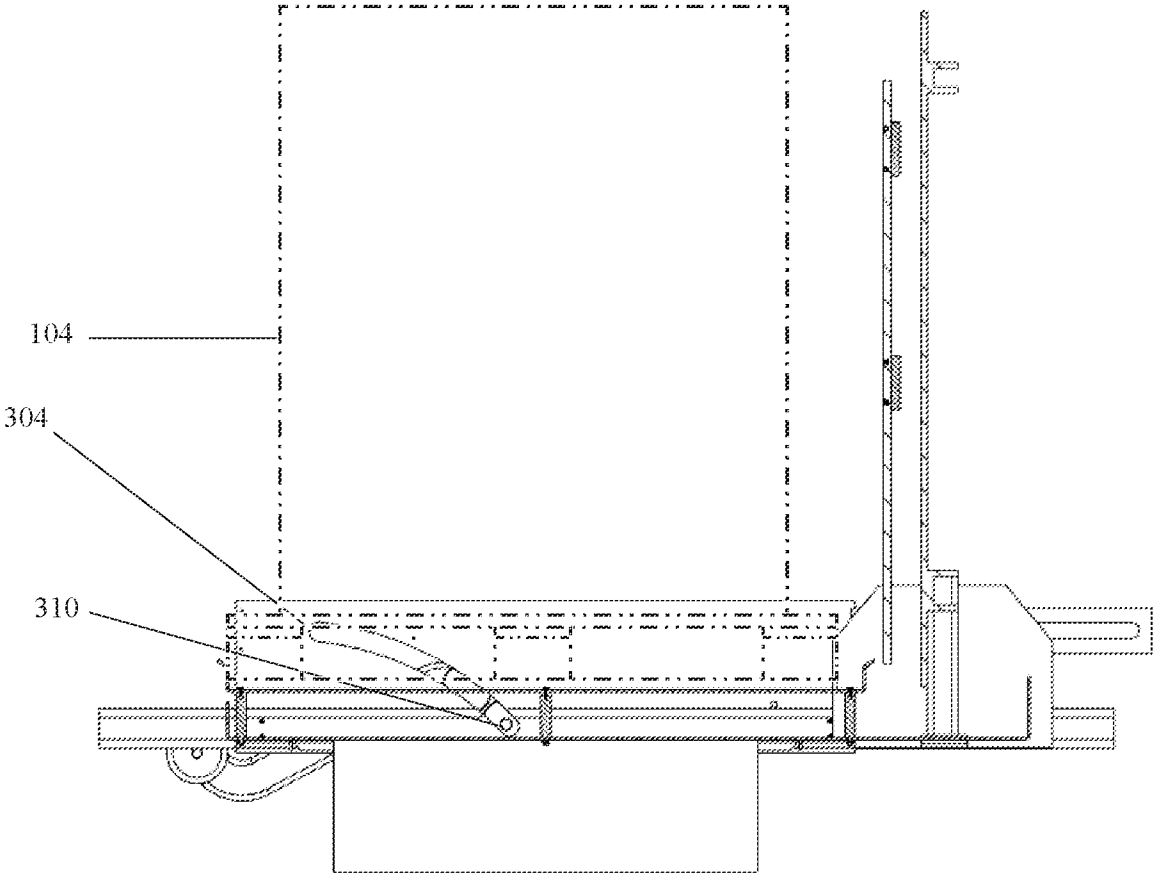
Figure 6:
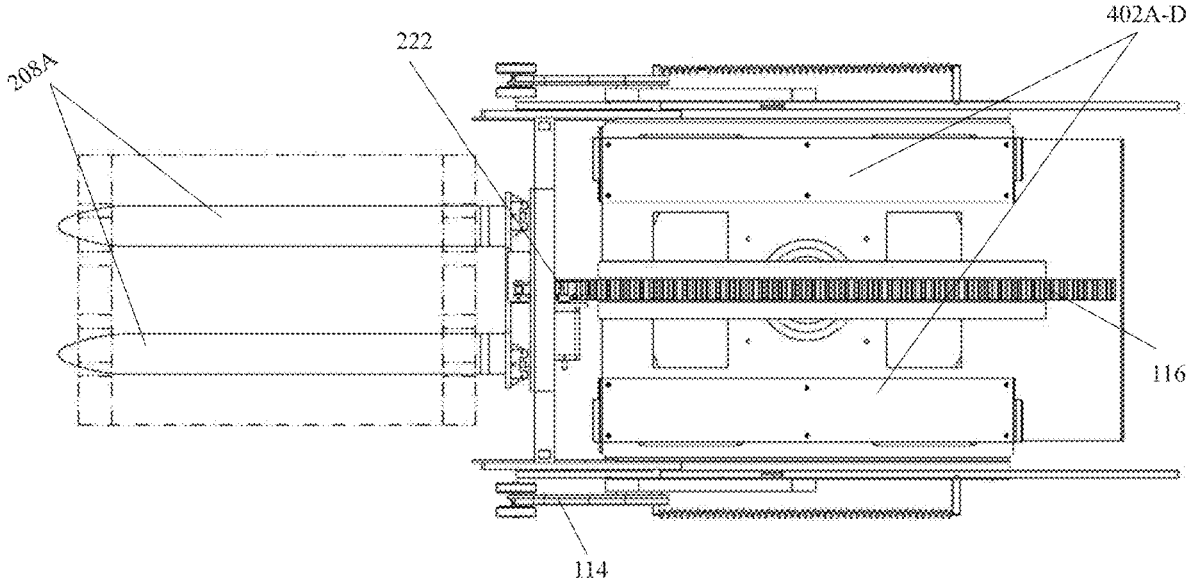
FIG. 6 is a top view of the unit load lifter with the autonomous mobile robot and the unit load, according to some embodiments of the present disclosure.
Figure 7A:
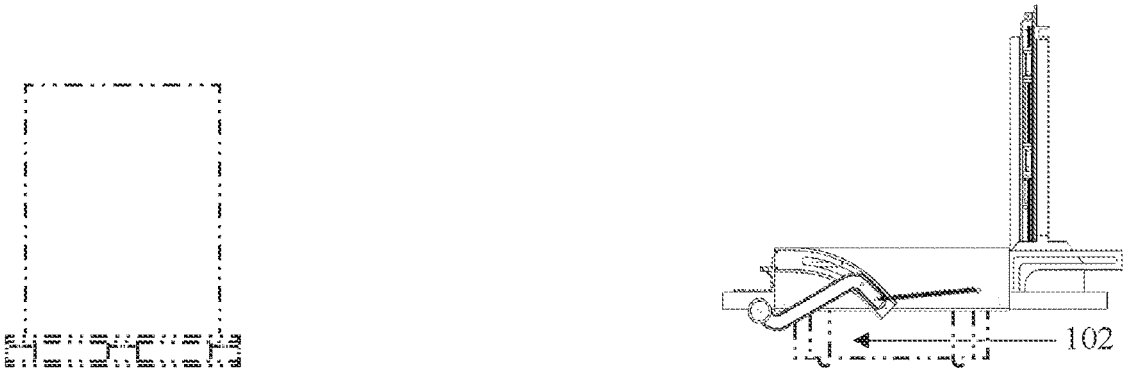
FIGS. 7A-7D are exemplary side views of the unit load lifter mounted onto the autonomous mobile robot and the unit load, according to some embodiments of the present disclosure.
Figure 7A:
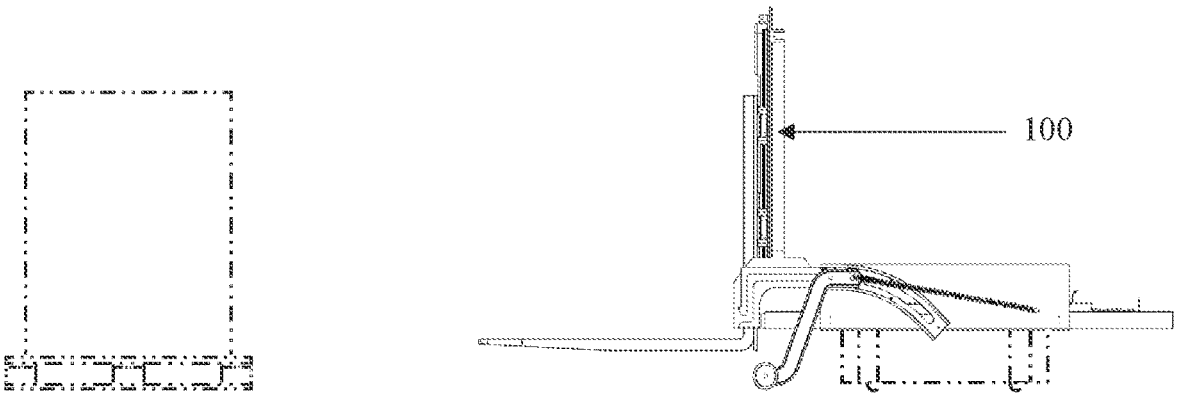
Figure 7B:
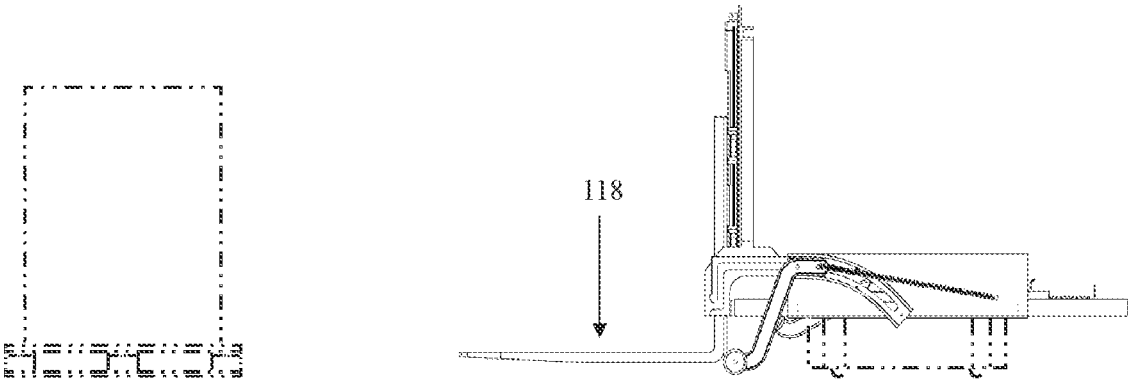
Figure 7B:
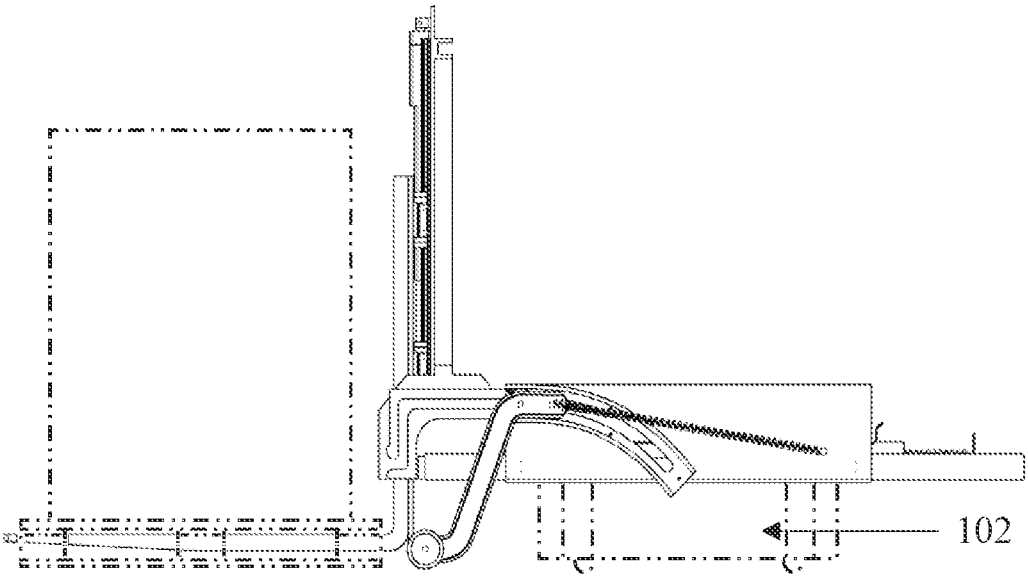
Figure 7C:
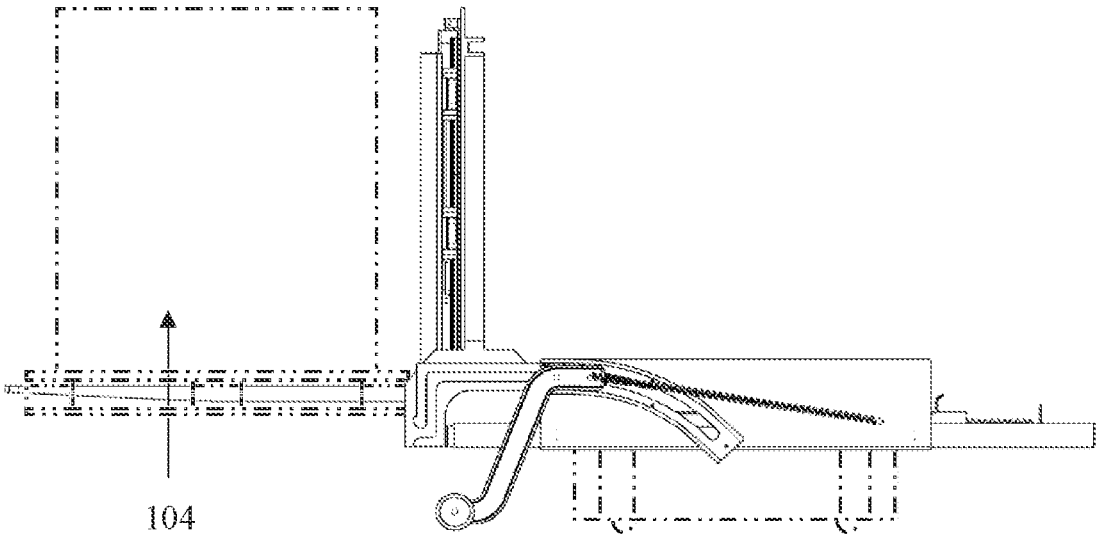
Figure 7C:
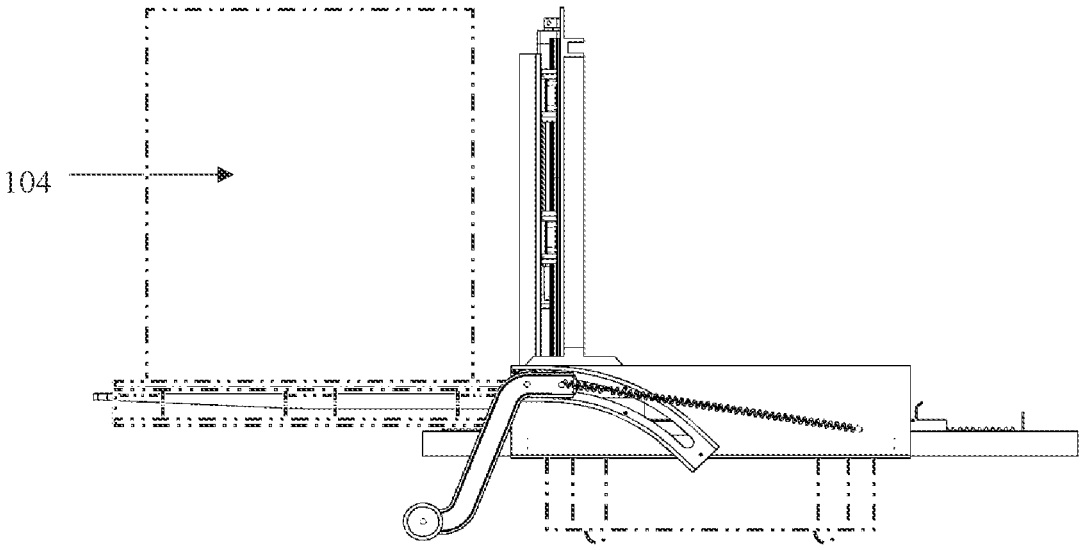
Figure 7D:
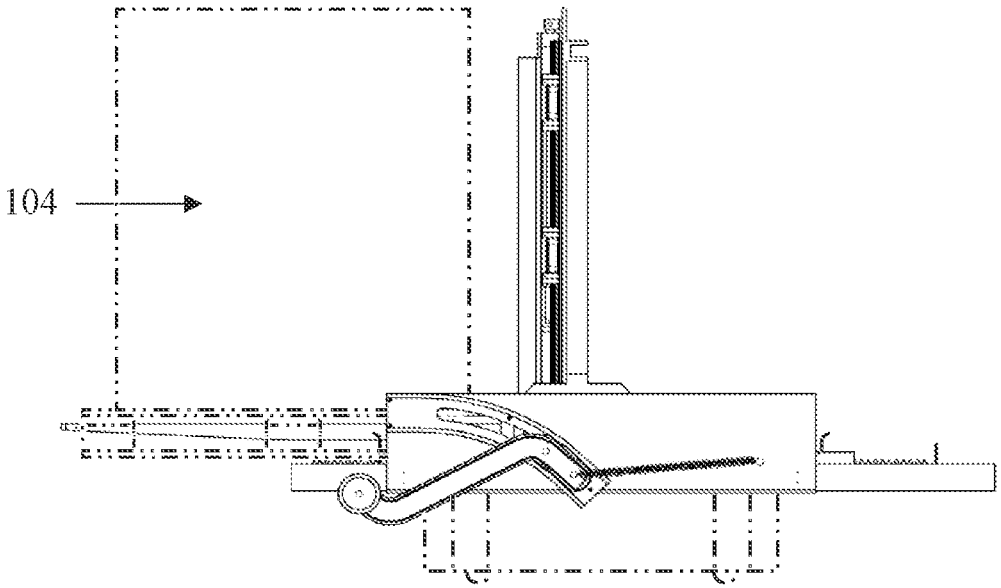
Figure 7D:
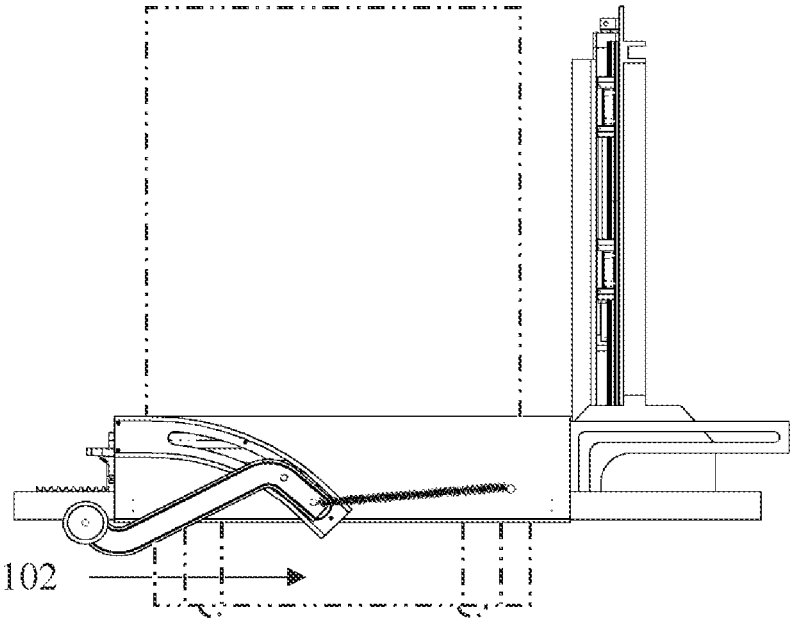

FIGS. 4A and 4B are side sectional views of the unit load lifter 100 with the autonomous mobile robot 102 and the unit load 104, according to some embodiments of the present disclosure. FIG. 5 is an isometric view of the base plate 106 of the unit load lifter 100, according to some embodiments of the present disclosure. FIG. 6 is a top view of the unit load lifter 100 with the autonomous mobile robot 102 and the unit load 104, according to some embodiments of the present disclosure. The horizontal slide unit 122 consists of the base plate 106 which holds one or more components of the unit load lifter 100 and transports the load to the AMR/AGV 102. In an embodiment, the base plate 106 is fixed to the surface of the AMR 102 by the plurality of the stand-offs 404A-B.

The plurality of unit load resting surface 402A-D includes at least one of (i) a central gap includes a space for the rack gear 116, and (ii) two gaps on either side of the plurality of unit load resting surface 402A-D which include a space for the plurality of forks 208A-B. In an embodiment, a top surface of the plurality of forks 208A-B is positioned below a top surface of the plurality of unit load resting surfaces 402A-D. The plurality of unit load resting surface 402A-D includes a plurality of unit load entry enabler 502A-D (as depicted in FIG. 5) at a plurality of ends to house the unit load 104 at a desired location. The plurality of unit load resting surface 402A-D includes a plurality of unit load position enabler 504A-B (as depicted in FIG. 5) to direct the unit load 104 towards the plurality of unit load resting surface 402A-D.

FIGS. 7A-7D are exemplary side views of the unit load lifter mounted onto the autonomous mobile robot 102 and the unit load 104, according to some embodiments of the present disclosure. The unit load lifter mounted on to the autonomous mobile robot (AMR) 102 or the autonomous guided vehicle (AGV) 102 can pick the unit load 104 up from a certain position and transfer from one position to another position autonomously. At step 1, the vertical axis fork assembly 118 of the unit load lifter 100 is shown at home position along with the horizontal slide unit 122 mounted on the top of the AMR 102. At this position both the counterbalance arms 114A-B of the unit load lifter 100 is at top position away from the floor surface. The rear portion of the AMR 102 consist of at least one sensor but not limited to like a LIDAR for navigation, a camera for sensing the unit load 104, other safety sensors, end purpose to enable pick of the unit load 104 from the floor surface and to transport at desired position. At step 2, the AMR 102 with the help of at least one sensor aligns itself with the unit load 104 in such way to avoid collisions. Once the alignment is performed the vertical axis fork assembly 118 of the unit load lifter 100 moves forward and reaches extreme rear end, in this process the counter-balance arms 114A-B are pushed forward till the wheels of the counterbalance arms 114A-B touches the floor surface.

At step 3, once the vertical axis fork assembly 118 reaches extreme rear position, which starts moving down for the process of picking the unit load 104. Once the vertical axis fork assembly 118 reaches a lowermost position the camera in the vertical mounting plate 210 of the vertical axis fork assembly 118 again checks for alignment of the plurality of forks 208A-B with the unit load 104. At step 4, once the final alignment is completed, the AMR 102 moves towards the unit load 104 until the object is completely on the top of the plurality of forks 208A-B. At step 5, the plurality of forks 208A-B on the vertical axis fork assembly 118 lift the unit load 104. At step 6, in this position the unit load 104 is lifted to a certain height with the vertical axis fork assembly 118 at an extreme rear position. At this position, wheels of the counterbalance arms 114A-B are still touching the floor surface to provide stability to the system.

At step 7, the vertical axis fork assembly 118 starts moving towards corresponding home position. Once centre of gravity of the unit load 104 and the vertical axis fork assembly 118 reaches a stable point, the wheels of the counterbalance arms 114A-B start to lift from the floor surface. The further movement of the vertical axis fork assembly 118 towards the home position lifts the counterbalance arms 114A-B till reaches corresponding top position. At step 8, the vertical axis fork assembly 118 with the unit load 104 resting on top reaches the corresponding home position and the AMR 102 enabled with the one or more sensors but not limited to (e.g., a LIDAR sensor, an Infrared sensor, and the camera) moves forward to deliver the unit load 104 to the corresponding destination.

The embodiments of present disclosure herein address problem of counterbalance shifting. The embodiment of present disclosure herein, thus provides the unit load lifter, which is compact and light in weight with minimal space required for turning, parking etc. The unit load lifter which does not require external help for lifting the pallets/objects from the ground and transferring to the top of the AMR. The object lifting unit can be used to pick up other objects with some modifications to the fork.

The written description describes the subject matter herein to enable any person skilled in the art to make and use the embodiments. The scope of the subject matter embodiments is defined by the claims and may include other modifications that occur to those skilled in the art. Such other modifications are intended to be within the scope of the claims if they have similar elements that do not differ from the literal language of the claims or if they include equivalent elements with insubstantial differences from the literal language of the claims.

It is to be understood that the scope of the protection is extended to such a program and in addition to a computer-readable means having a message therein; such computer-readable storage means contain program-code means for implementation of one or more steps of the method, when the program runs on a server or mobile device or any suitable programmable device. The hardware device can be any kind of device which can be programmed including e.g., any kind of computer like a server or a personal computer, or the like, or any combination thereof. The device may also include means which could be e.g., hardware means like e.g., an application-specific integrated circuit (ASIC), a field-programmable gate array (FPGA), or a combination of hardware and software means, e.g., an ASIC and an FPGA, or at least one microprocessor and at least one memory with software processing components located therein. Thus, the means can include both hardware means and software means. The method embodiments described herein could be implemented in hardware and software. The device may also include software means. Alternatively, the embodiments may be implemented on different hardware devices, e.g., using a plurality of CPUs.

The embodiments herein can comprise hardware and software elements. The embodiments that are implemented in software include but are not limited to, firmware, resident software, microcode, etc. The functions performed by various components described herein may be implemented in other components or combinations of other components. For the purposes of this description, a computer-usable or computer readable medium can be any apparatus that can comprise, store, communicate, propagate, or transport the program for use by or in connection with the instruction execution system, apparatus, or device.

The illustrated steps are set out to explain the exemplary embodiments shown, and it should be anticipated that ongoing technological development will change the manner in which particular functions are performed. These examples are presented herein for purposes of illustration, and not limitation. Further, the boundaries of the functional building blocks have been arbitrarily defined herein for the convenience of the description. Alternative boundaries can be defined so long as the specified functions and relationships thereof are appropriately performed. Alternatives (including equivalents, extensions, variations, deviations, etc., of those described herein) will be apparent to persons skilled in the relevant art(s) based on the teachings contained herein. Such alternatives fall within the scope of the disclosed embodiments. Also, the words "comprising," "having," "containing," and "including," and other similar forms are intended to be equivalent in meaning and be open ended in that an item or items following any one of these words is not meant to be an exhaustive listing of such item or items, or meant to be limited to only the listed item or items. It must also be noted that as used herein and in the appended claims, the singular forms "a," "an," and "the" include plural references unless the context clearly dictates otherwise.

Furthermore, one or more computer-readable storage media may be utilized in implementing embodiments consistent with the present disclosure. A computer-readable storage medium refers to any type of physical memory on which information or data readable by a processor may be stored. Thus, a computer-readable storage medium may store instructions for execution by one or more processors, including instructions for causing the processor(s) to perform steps or stages consistent with the embodiments described herein. The term "computer-readable medium" should be understood to include tangible items and exclude carrier waves and transient signals, i.e., be non-transitory. Examples include random access memory (RAM), read-only memory (ROM), volatile memory, nonvolatile memory, hard drives, CD ROMs, DVDs, flash drives, disks, and any other known physical storage media.

It is intended that the disclosure and examples be considered as exemplary only, with a true scope of disclosed embodiments being indicated by the following claims.

What is claimed is:

1. A unit load lifter (100) mounted on an autonomous mobile robot (AMR) (102) to carry a unit load (104), comprising:

a horizontal slide unit (122), comprising:

a base plate (106) of the unit load lifter (100) mounted on the AMR (102), wherein the base plate (106) is configured to hold a plurality of components of the unit load lifter (100);

a plurality of unit load resting surfaces (402A-D) mounted on to the base plate (106) with a plurality of stand-offs (404A-B), wherein the unit load (104) is mounted on at least two unit load resting surfaces from the plurality of unit load resting surfaces (402A-D);

a plurality of fixed guides (120A-N) integrated with the base plate (106) to house a vertical axis fork assembly (118) by a plurality of rollers (218A-N), wherein the plurality of rollers (218A-N) are mounted on a roller mounting plate (226);

a pinion gear (222) and a motor (220) mounted on the vertical axis fork assembly (118) coupled with a rack gear (116) for creating a desired horizontal motion; and a plurality of counterbalance curvy slides (302A-B) integrated with the base plate (106); and wherein the vertical axis fork assembly (118), comprising:

a support plate weldment (224) with the plurality of rollers (218A-N) integrated on either side to roll on at least one channel in the plurality of fixed guides (120A-N) of the horizontal slide unit (122) to create a horizontal motion of the vertical axis fork assembly (118);

a plurality of linear motion (LM) guide blocks (206A-N) sandwiched between a sliding plate (202) and a plurality of linear motion (LM) rails (228A-N), wherein the sliding plate (202) is configured to slide vertically and linearly up and down, wherein the plurality of LM rails (228A-N) are mounted on a vertical mounting plate (210);

at least one fork from a plurality of forks (208A-B) is vertically mounted on the sliding plate (202); and an actuating end of a linear actuator (204) connected to the sliding plate (202) to drive the at least one fork up and down.

2. The unit load lifter (100) as claimed in claim 1, wherein the plurality of unit load resting surfaces (402A-D) comprises at least one of (i) a central gap comprising a space for the rack gear (116), and (ii) two gaps on either side of the plurality of unit load resting surfaces (402A-D), which comprises a space for the plurality of forks (208A-B).

3. The unit load lifter (100) as claimed in claim 1, wherein the plurality of unit load resting surfaces (402A-D) comprises a plurality of unit load entry enabler (502A-D) at a plurality of ends to house the unit load (104) at a desired location.

4. The unit load lifter (100) as claimed in claim 3, wherein the plurality of unit load resting surfaces (402A-D) comprises a plurality of unit load position enabler (504A-B) to direct the unit load (104) towards the plurality of unit load resting surfaces (402A-D).

5. The unit load lifter (100) as claimed in claim 1, wherein a plurality of counterbalance arms (114A-B) corresponds to a left hand (LH) counterbalance arm (114A) and a right hand (RH) counterbalance arm (114B), wherein the plurality of counterbalance curvy slides (302A-B) corresponds to a left hand (LH) counterbalance curvy slide (302A) and a right hand (RH) counterbalance curvy slide (302B).

6. The unit load lifter (100) as claimed in claim 5, wherein the LH counterbalance curvy slide (302A) consists of the LH counterbalance arm (114A) which rolls in a curvy channel with at least two rollers, wherein the at least two rollers correspond to a guided roller (306) and an anti-rotation roller (308) respectively, wherein the RH counterbalance curvy slide (302B) consists of the RH counterbalance arm (114B).

7. The unit load lifter (100) as claimed in claim 6, wherein a plurality of coil springs (124A-B) are attached to the guided roller (306) to provide a pulling force for retaining the guided roller (306) along with the plurality of counterbalance arms (114A-B) towards a second end (Y) of the plurality of counterbalance curvy slides (302A-B) thereby preventing free movement of the counterbalance arms (114A-B), wherein the guided roller (306) is not engaged with a plurality of slotted links (110A-B).

8. The unit load lifter (100) as claimed in claim 7, wherein a track roller (310) of the guided roller (306) passes through a track clearance opening (304B) of the plurality of counterbalance curvy slide (302A-B) and a track clearance opening (304A) of the base plate (106) to provide a rolling contact with a track (406) of the plurality of slotted links (110A-B).

9. The unit load lifter (100) as claimed in claim 8, wherein the track roller (310) of the guided roller (306) engages with the open end (C) when the vertical axis fork assembly (118) moves towards the unit load (104) placed on a floor surface.

10. The unit load lifter (100) as claimed in claim 9, wherein a locating step (324) of the guided roller (306) causes movement of the LH counterbalance arm (114A) towards the floor surface.

11. The unit load lifter (100) as claimed in claim 9, wherein the vertical axis fork assembly (118) moves away from a loading position towards a central portion of the AMR (102) when the track roller (310) of the guided roller (306) is completely disengaged from the open end C, wherein the at least one counterbalance arm (114A) is at top position to initiate transportation of the unit load (104).

12. The unit load lifter (100) as claimed in claim 8, wherein the track roller (310) moves from the connecting end B to the closed end A of the track (406) of the plurality of the slotted links (110A-B) when the vertical axis fork assembly (118) moves further towards the unit load (104), wherein the bearing roller (320) of the guided roller (306) without motion to retain the at least one counterbalance arm (114A) towards the floor surface.

13. The unit load lifter (100) as claimed in claim 7, wherein the plurality of slotted links (110A-B) comprises a horizontal segment of a slotted channel with a closed end (A), and a connecting end (B) which are connected to a vertical segment of the slotted channel, wherein the vertical segment of the slotted channel is open at an open end (C).

14. The unit load lifter (100) as claimed in claim 13, wherein the connecting end (B) and the open end (C) engage when the vertical axis fork assembly (118) moves towards the unit load (104) placed on the floor surface.

15. The unit load lifter (100) as claimed in claim 14, wherein the track roller (310) moves from the open end (C) to the connecting end (B) of the plurality of slotted links (110A-B) when the vertical axis fork assembly (118) moves towards the unit load (104) placed on the floor surface.

16. The unit load lifter (100) as claimed in claim 13, wherein the horizontal segment between the closed end A and the connecting end B integrated with the guided roller (306) and the anti-rotation roller (308) with no relative motion to maintain the at least one counterbalance arm (114A) at a desired position.

17. The unit load lifter (100) as claimed in claim 16, wherein the anti-rotation roller (308) is coupled with the guided roller (306).

18. The unit load lifter (100) as claimed in claim 7, wherein a bearing roller (320) of the guided roller (306) moves from the second end (Y) of the plurality of counterbalance curvy slides (302A-B) to a first end (Z) of the plurality of counterbalance curvy slides (302A-B).

19. The unit load lifter (100) as claimed in claim 18, wherein the bearing roller (320) of the guided roller (306) along with a bearing roller (328) of the anti-rotation roller (308) with movement constrained between an upper slot (312) of the plurality of counterbalance curvy slides (304A-B) and a lower slot (314) of the plurality of counterbalance curvy slides (304A-B), thereby causing a specific curvy path along the plurality of counterbalance arms (114A-B).

20. The unit load lifter (100) as claimed in claim 6, wherein the guided roller (306) and the anti-rotation roller (308) moves along the plurality of counterbalance curvy slides (302A-B).

* * * * *